US009393606B2

(12) United States Patent
Stranz et al.

(10) Patent No.: US 9,393,606 B2
(45) Date of Patent: Jul. 19, 2016

(54) IGNITION DEVICE FOR EXPLOSIVE FORMING

(75) Inventors: Andreas Stranz, Reichenau (AT); Alexander Zak, Moedling (AT); Philipp Stoeger, Wildenduernbach (AT)

(73) Assignee: Cosma Engineering Europe AG (AT)

( * ) Notice: Subject to any disclaimer, the term of this patent is extended or adjusted under 35 U.S.C. 154(b) by 372 days.

(21) Appl. No.: 12/601,411

(22) PCT Filed: May 7, 2008

(86) PCT No.: PCT/EP2008/003670

§ 371 (c)(1),
(2), (4) Date: Nov. 23, 2009

(87) PCT Pub. No.: WO2008/141729

PCT Pub. Date: Nov. 27, 2008

(65) Prior Publication Data

US 2010/0175449 A1 Jul. 15, 2010

(30) Foreign Application Priority Data

May 22, 2007 (DE) ..... 10 2007 023 669

(51) Int. Cl.
*B21D 26/08* (2006.01)
*B21D 26/12* (2006.01)

(52) U.S. Cl.
CPC ..... *B21D 26/08* (2013.01); *B21D 26/12* (2013.01)

(58) Field of Classification Search
CPC ..... B21D 26/08; B21D 39/042; B21D 26/14; B21D 26/12; B23K 20/085; F42D 3/00; B01J 3/08; B21C 37/047; F02B 1/12; F02P 23/04; F02P 7/0632; H01T 13/08
USPC ..... 72/56, 706; 29/421.2; 123/143 R, 143 B, 123/146.5 R, 169 R; 228/107, 2.5; 431/361, 431/362, 365, 191
See application file for complete search history.

(56) References Cited

U.S. PATENT DOCUMENTS

| | | | | | |
|---|---|---|---|---|---|
| 1,165,020 | A | * | 12/1915 | Pollock | 123/143 R |
| 1,910,362 | A | | 5/1933 | Powers | |
| 2,110,888 | A | * | 3/1938 | Meredith | 123/73 R |
| 2,903,051 | A | * | 9/1959 | Blackman | C21D 9/70 126/91 A |
| 3,057,313 | A | * | 10/1962 | Setser | 72/56 |
| 3,160,949 | A | | 12/1964 | Bussey et al. | |
| 3,195,334 | A | * | 7/1965 | Filler | B21D 26/08 29/421.2 |

(Continued)

FOREIGN PATENT DOCUMENTS

| | | |
|---|---|---|
| DE | 1452667 U | 12/1938 |
| DE | 1808942 A1 | 6/1970 |

(Continued)

*Primary Examiner* — David Bryant
*Assistant Examiner* — Lawrence Averick
(74) *Attorney, Agent, or Firm* — Dickinson Wright PLLC

(57) ABSTRACT

Through the invention, an ignition device for explosive forming of work pieces in a forming die, which has an ignition mechanism and an ignition tube, and in which the ignition tube guides the explosion ignited by the ignition mechanism into the work piece inserted in the forming die, is to be improved, in that it permits, in practice, an arrangement of the ignition mechanism and forming die that is easier to handle and geared toward the occurring explosion forces. This task is solved by an ignition device, in which a curved guide is provided between the ignition mechanism and the forming die.

13 Claims, 2 Drawing Sheets

(56) References Cited

U.S. PATENT DOCUMENTS

| | | | | | |
|---|---|---|---|---|---|
| 3,222,902 | A * | 12/1965 | Brejcha | B21D 26/12 | 29/421.2 |
| 3,252,312 | A * | 5/1966 | Maier | 72/56 | |
| 3,286,496 | A * | 11/1966 | Burk | B21D 22/205 | 72/350 |
| 3,342,048 | A | 9/1967 | Johnson et al. | | |
| 3,443,409 | A * | 5/1969 | Matsukin | 72/56 | |
| 3,559,431 | A * | 2/1971 | Noe et al. | B21D 1/05 | 72/13.3 |
| 3,600,921 | A | 8/1971 | Schwarz | | |
| 3,640,110 | A * | 2/1972 | Inoue | 72/56 | |
| 3,643,482 | A * | 2/1972 | Hertel et al. | 72/56 | |
| 3,654,788 | A | 4/1972 | Kimura | | |
| 3,661,004 | A | 5/1972 | Lee et al. | | |
| 1,280,451 | A | 7/1972 | Hagen | | |
| 3,737,975 | A | 6/1973 | McKinnon, Jr. | | |
| 3,742,746 | A * | 7/1973 | Erlandson | 72/56 | |
| 3,750,441 | A * | 8/1973 | Schneider | B21D 26/10 | 72/56 |
| 3,869,938 | A * | 3/1975 | Schlotterbeck | F01L 1/047 | 123/90.6 |
| 4,030,329 | A * | 6/1977 | Chachin | B21D 26/10 | 72/56 |
| 4,067,291 | A * | 1/1978 | Park | 118/699 | |
| 4,187,709 | A | 2/1980 | Roland et al. | | |
| 4,220,027 | A * | 9/1980 | Johnson et al. | 72/56 | |
| 4,229,965 | A * | 10/1980 | Spacek | B21D 22/205 | 267/119 |
| 4,455,733 | A * | 6/1984 | Smith et al. | 29/421.2 | |
| 4,471,640 | A | 9/1984 | Kortenski et al. | | |
| 4,494,392 | A * | 1/1985 | Schroeder | 72/56 | |
| 4,571,800 | A * | 2/1986 | Faupell | 29/890.01 | |
| 4,635,840 | A * | 1/1987 | Cenanovic | 228/107 | |
| 4,738,012 | A * | 4/1988 | Hughes et al. | 29/888.1 | |
| 4,788,841 | A | 12/1988 | Calhoun et al. | | |
| 4,856,311 | A * | 8/1989 | Conaway | 72/56 | |
| 5,187,962 | A * | 2/1993 | Bilko et al. | 72/62 | |
| 5,220,727 | A * | 6/1993 | Hochstein | 29/888.1 | |
| 5,339,666 | A * | 8/1994 | Suzuki et al. | 72/56 | |
| 5,377,594 | A * | 1/1995 | Alford | 102/308 | |
| 5,379,621 | A * | 1/1995 | Suzuki et al. | 72/56 | |
| 5,611,477 | A * | 3/1997 | Wang | 228/107 | |
| 6,591,649 | B1 * | 7/2003 | Gafri et al. | 72/56 | |
| 7,493,787 | B2 * | 2/2009 | Golovashchenko | B21D 26/12 | 29/421.1 |
| 2004/0234914 | A1 * | 11/2004 | Hale | A61M 11/041 | 431/269 |
| 2006/0060601 | A1 | 3/2006 | Kubacki et al. | | |
| 2006/0107512 | A1 * | 5/2006 | Dicesare | B21D 26/025 | 29/421.1 |
| 2008/0134741 | A1 * | 6/2008 | Golovashchenko | B21D 26/12 | 72/63 |
| 2009/0205396 | A1 * | 8/2009 | Zak | B21D 26/08 | 72/430 |
| 2010/0083932 | A1 * | 4/2010 | Kathan | 123/244 | |

FOREIGN PATENT DOCUMENTS

| | | | |
|---|---|---|---|
| DE | 2043251 | | 9/1970 |
| DE | 1777207 | A1 | 4/1971 |
| DE | 1777208 | A1 | 4/1971 |
| DE | 2059181 | A1 | 6/1972 |
| DE | 2107460 | A1 | 8/1972 |
| DE | 2357295 | A1 | 5/1974 |
| DE | 2908561 | A1 | 10/1979 |
| DE | 3341488 | A1 | 5/1984 |
| DE | 3305615 | A1 | 8/1984 |
| DE | 3590248 | C2 | 6/1986 |
| DE | 3512015 | A1 | 10/1986 |
| DE | 3709181 | A1 | 9/1988 |
| DE | 4035894 | C1 | 1/1992 |
| DE | 4232913 | C2 | 4/1994 |
| DE | 19536292 | | 4/1997 |
| DE | 19638679 | A1 | 3/1998 |
| DE | 19638688 | A1 | 3/1998 |
| DE | 19709918 | A1 | 9/1998 |
| DE | 19818572 | C1 | 11/1999 |
| DE | 19852302 | A1 | 5/2000 |
| DE | 19915383 | B4 | 10/2000 |
| DE | 19957836 | A1 | 6/2001 |
| DE | 10328154 | A1 | 12/2004 |
| DE | 102005025660 | A1 | 12/2006 |
| DE | 102007007330 | | 2/2007 |
| DE | 102007023669 | | 5/2007 |
| DE | 102006008533 | A1 | 8/2007 |
| DE | 102007036196 | | 8/2007 |
| DE | 102006019856 | A1 | 11/2007 |
| DE | 102006037754 | B3 | 1/2008 |
| DE | 102008006979 | | 1/2008 |
| DE | 102006037742 | A1 | 2/2008 |
| DE | 102006060372 | A1 | 6/2008 |
| EP | 0151490 | A2 | 8/1985 |
| EP | 148459 | B1 | 11/1987 |
| EP | 0288705 | A2 | 11/1988 |
| EP | 00371018 | B1 | 7/1992 |
| EP | 0592068 | A1 | 4/1994 |
| EP | 0590262 | B1 | 4/1996 |
| EP | 0765675 | A2 | 4/1997 |
| EP | 0830906 | A1 | 3/1998 |
| EP | 0830907 | A2 | 3/1998 |
| EP | 1702695 | A2 | 9/2006 |
| EP | 1849551 | A2 | 10/2007 |
| GB | 742460 | | 6/1952 |
| GB | 878178 | A | 9/1961 |
| GB | 1129562 | A | 10/1968 |
| GB | 1280451 | A | 7/1972 |
| GB | 1419889 | | 12/1975 |
| GB | 1436538 | | 5/1976 |
| GB | 1501049 | A | 2/1978 |
| GB | 1542519 | A | 3/1979 |
| GB | 2009651 | A | 6/1979 |
| GB | 2047147 | A | 11/1980 |
| JP | 55-139128 | A | 10/1980 |
| JP | 58145381 | A | 8/1983 |
| JP | 2117728 | A | 5/1990 |
| JP | 70505176 | | 2/1995 |
| JP | 2001054866 | A | 2/2001 |
| JP | 2002093379 | A | 3/2002 |
| JP | 2007-222778 | A | 9/2007 |
| WO | 9933590 | A2 | 7/1999 |
| WO | 0000309 | A | 1/2000 |
| WO | 0000309 | A1 | 1/2000 |
| WO | 2004028719 | A1 | 4/2004 |
| WO | 2006128519 | A | 12/2006 |

* cited by examiner

IGNITION DEVICE FOR EXPLOSIVE FORMING

The invention concerns an ignition device for explosive forming of work pieces in a forming die.

Explosive forming of a work piece situated in a forming die is known from German Patent Application No. 10 2006 060 372.9. A gas mixture is ignited in the interior of the work piece by an ignition device and the propagating explosion imparts a final shape to the work piece.

Commercial presses are retrofitted, in practice, for explosive forming, in which there is often only a small space available for the ignition device in an extension of the horizontal die-parting plane. In addition, according to the work piece, the forming dies have different connections. Arrangement of the ignition mechanism and forming die, relative to each other, is therefore problematic in practice.

The underlying task of the invention is therefore to improve an ignition device, so that it permits an arrangement of the ignition mechanism and forming die that is easier to handle, in practice, and geared toward the occurring explosion forces.

This task is solved according to the invention by an ignition device for explosive forming of work pieces in a forming die. The ignition device includes an ignition mechanism, an ignition tube that guides an explosion ignited by the ignition mechanism into the work piece inserted in the forming die, and a curved guide provided between the ignition mechanism and the forming die.

The curved guide arranged between the ignition mechanism and the forming die permits a desired orientation of the die-parting plane relative to the axis of the ignition device. Orientation of the forming die and ignition device can be accomplished relative to the spatial conditions. In addition, this arrangement permits good development and guiding of the propagating explosion.

In an advantageous embodiment of the invention, the curved guide can have a cross-section that remains constant over its length. Owing to the fact that the explosion can propagate through the same cross section, its deflection can occur essentially without loss.

The curved guide can advantageously progress continually over its length. The continuous progress can favor uniform propagation of the explosion through the curved guide, so that its energy can be properly transmitted.

It can be advantageous, if the curved guide has a constant curvature over its length. This can support propagation of the explosion front.

In particular, the curved guide can be provided between the ignition tube and the forming die. Thereby, the ignition tube can be used for build-up of the explosion, which then can be passed with low loss from the curved guide to the forming die.

In an advantageous embodiment, the curved guide can contain steel and/or copper-beryllium (Cu—Be). These materials can be particularly suited for withstanding the forces acting upon them through the explosion.

In a particular embodiment, the curved guide can be at least partially eroded in the solid material. The outcome of this can be an integral curved guide, which can have good tightness in conjunction with a high stability.

In a particular mode, the curved guide can have a tube in two-part form. Thereby, the functions of tightness and stability can then be implemented by coordinating them with one another. The two-part form can hold the curved guide well together and the explosion can propagate well through the tube.

In a particular application, the curved guide can serve as a rising pipe for a mixed gas-water filling. A gas mixture is then ignited over the liquid surface and the energy transfer occurs over the gas-liquid interface. This method can reduce the required amount of gas, largely avoid burning of the work piece and the liquid can be additionally used for cooling. Owing to the fact that the curved guide can compensate for angular orientations of the forming die and ignition device, in which the ignition device is mostly oriented with a rising angle, an additional rising pipe for the gas can be dispensed with by using the curved guide as a rising pipe. In addition, the curved guide permits a good transfer from the propagating explosion to the forming pressure.

An embodiment of the invention is described below with reference to the drawing. In the drawings.

Figure 1:
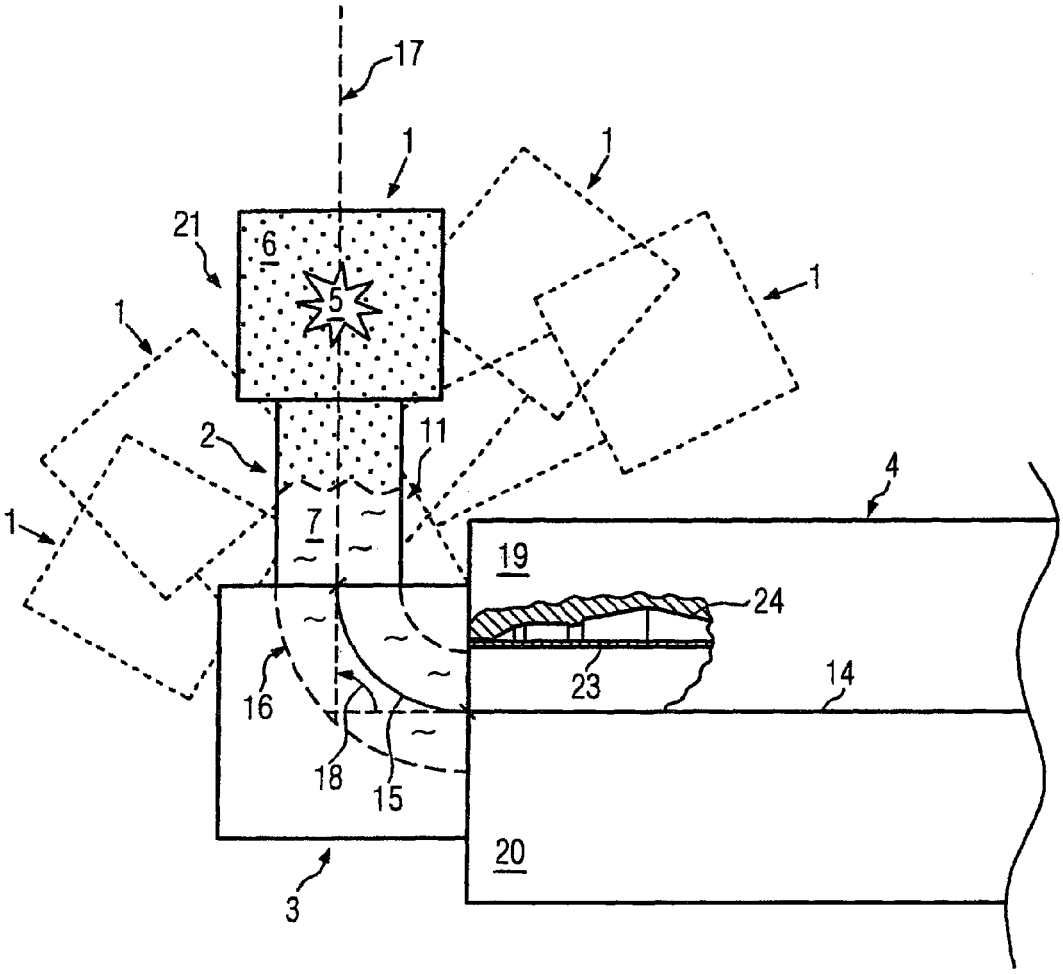
FIG. 1 shows a schematic view of an ignition device according to the invention.

A closed forming die 4 with upper 19 and lower boxes 20 is shown in broken lines in FIG. 1. The separation edge between upper 19 and lower box 20 is simultaneously the horizontal die-parting plane 14 of the forming die 4. A cutout in upper box 19 makes a work piece 23 inserted in a cavity 24 visible. An ignition device 1 has an ignition space 21, in which an ignition mechanism 5, symbolized by an ignition spark, is arranged. An ignition tube 2 is connected to the ignition space 21 and facing the forming die 4. A longitudinal axis 17 of the ignition device 1 runs vertically in this embodiment. The axis 17 of ignition device 1 meets the die-parting plane 14 of forming die 4, continued in the dashed line, under an orientation angle 18. The orientation angle 18 here corresponds to 90°, but can also assume another value. The dashed depictions of the ignition device 1 show other exemplary orientations of the ignition device 1 relative to forming die 4 and therefore different orientation angles 18, for example, in the ranges from 30 to 60°, 60 to 80°, 80 to 100°, 100 to 130° and 130 to 160°, in which several ranges can also be combined. The forming die 4 and/or its die-parting plane 14 is not necessarily oriented horizontally, and the ignition device 1 is not necessarily oriented vertically; an arrangement free on one or both sides is therefore possible.

A curved guide 3 with a space-filling arc segment, shown with a dashed line, is provided between ignition mechanism 1 and forming die 4, more precisely, between ignition tube 2 here and the forming die 4. This curved guide 3 is configured, so that it creates a seamless transition to each, the ignition tube 2 and the cavity 24 of forming die 4. In this example, it is a curved guide 3 with a constant internal cross-section 22, i.e. a free passage of constant size and constant curvature 16 over the length 15 of curved guide 3. This has a 90° arc, corresponding to the opposite angle of orientation angle 18.

A mixed gas-water filling is shown here, in which the water 7, symbolized as waves, fills up the cavity of the forming die 4, the curved guide 3, and part of the ignition tube 2. The remaining space, namely, ignition space 21 and the elevated part of ignition tube 2, are filled with an ignitable gas 6, symbolized by dots. The interface therefore runs within ignition tube 2, which functions as a rising pipe 11 on this account; however, the curved guide 3 can just as well be used as rising pipe 11 or the gas 6 occupy part of cavity 24 of forming die 4. Pure gas filling is also possible.

An explosion, initiated by the ignition mechanism 5 in ignition device 1, fills up the ignition space 21 and propagates in ignition tube 2. On reaching the interface between gas 6 and water 7, the energy is transferred to water 7. The forming pressure is directed with low loss through the curved guide 3 into the interior of the work piece 23 inserted into forming die 4. This leads to forcing of the work piece 23 against cavity 24 of the forming die 4 and therewith forms the work piece 23.

Figure 2A:
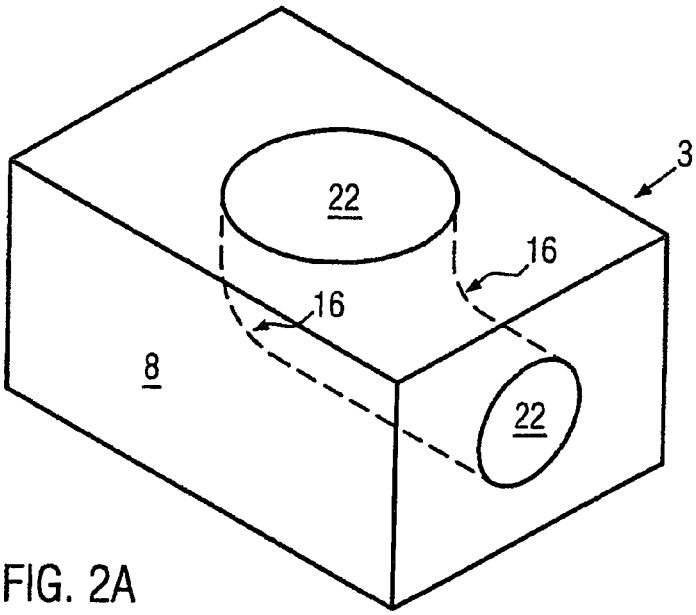
FIG. 2A shows a curved guide of the ignition device of FIG. 1 in a perspective view.

The curved guide 3 in FIG. 2A is entirely made of a solid material 8, for example, it is carved out by eroding. The invisible peripheral edges of the arc in the solid material 8, shown here as a block, are marked with a dashed line. This curved guide has a continuous trend over its length 15, and is also configured for an orientation angle 18 of 90° between ignition device 1 and die-parting plane 14.

An integral casting of the curved guide 3 is also possible.

Figure 2B:
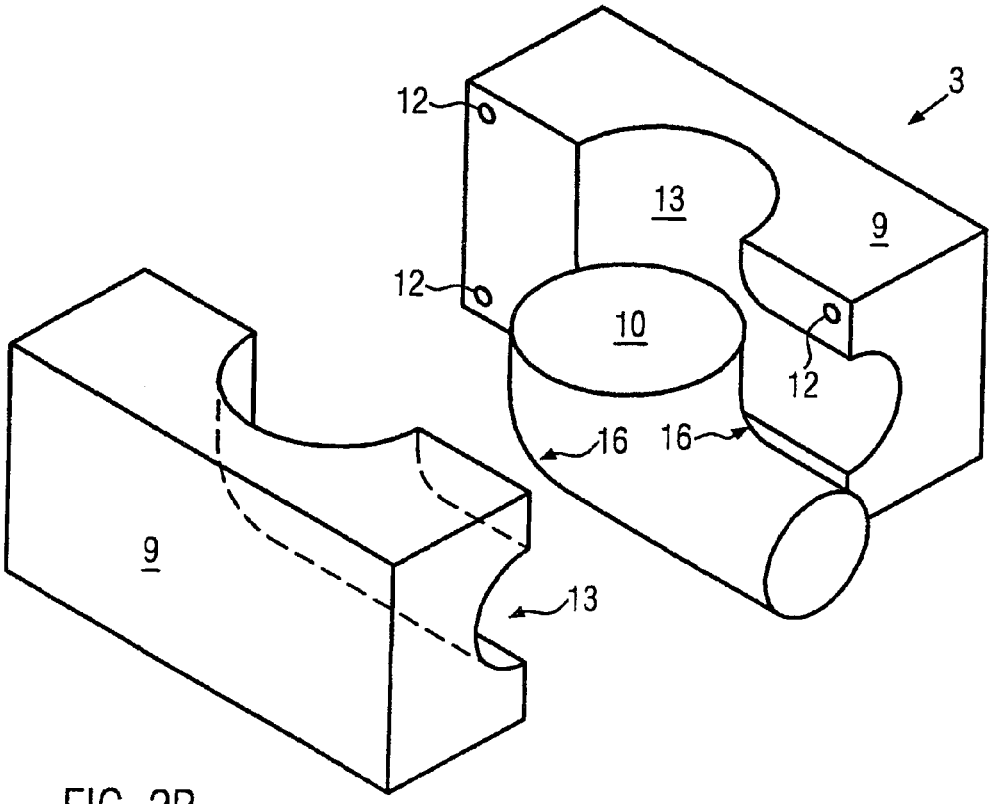
FIG. 2B shows another curved guide of the ignition device of FIG. 1 in an exploded perspective view.

FIG. 2B shows a production variant of FIG. 2A with a multipart curved guide 3. The actual explosion passage is formed by a tube 10 in the interior of curved guide 3. This tube 10 is inserted into corresponding recesses 13 of a two-part mold 9 in shape-mated fashion. The mold 9 is combined via joints 12, and in doing so a vertical mold parting line is recommended.

The arc of the curved guide 3 can also be configured, for example, as an ellipsoidal or parabolic arc or catenoid, differing from the examples shown heretofore. A continuous trend of a curved guide 3, however, is recommended in each case, just as a constant curvature 16 over length 15. If possible on the connection side, a constant cross-section 22 of curved guide 3 over its length 15 is advantageous.

The invention claimed is:

1. A device for explosive forming of a work piece comprising:

a forming die;

an ignition device including an ignition mechanism;

an ignition tube extending from said ignition device, and configured to guide the explosion ignited by the ignition mechanism into a work piece inserted in said forming die; and a two-part curved guide extending between said ignition tube and said forming die, wherein said curved guide is capable of being filled with liquid, and wherein said curved guide forms an arc, having a constant curvature, extending between an end of said ignition tube and said forming die.

2. The device according to claim 1, wherein the curved guide has a constant cross-section over its length.

3. The device according to claim 2, wherein the curved guide has a constant curvature over its length.

4. The device according to claim 1, wherein the curved guide has a constant curvature over its length.

5. The device according to claim 1, wherein the curved guide contains at least one of steel and copper-beryllium (Cu-Be).

6. The device according to claim 1, wherein the curved guide is configured to serve as a rising pipe in a mixed gas-water filling.

7. The device according to claim 1, wherein said curved guide includes a tube between said ignition tube and said forming die, and within said two part form.

8. The device according to claim 7, wherein said two part form includes recesses corresponding to the shape of said tube.

9. The device according to claim 7, wherein said curved guide includes recesses and wherein said tube and said recesses are shape-mated.

10. The device of claim 1, wherein said forming die includes upper and lower boxes separated by a horizontal die parting plane and wherein said curved guide includes a vertical mold part between each of the two part form.

11. The device of claim 1 wherein said two part form is configured to be separated into two separate pieces.

12. The device of claim 1 wherein the liquid is water, and the curved guide is configured to be at least partially filled with water.

13. A device for explosive forming of work pieces comprising:

a forming die;

an ignition device including an ignition mechanism;

an ignition tube extending from said ignition device, and configured to guide the explosion ignited by the ignition mechanism into a work piece inserted in said forming die;

a block defining a curved guide extending between said ignition tube and said forming die, wherein said curved guide is configured to be filled with water, and wherein said curve guide forms an arc, having a constant curvature, extending between an end of said ignition tube and said forming die.

* * * * *